US005333857A

United States Patent [19]

Lallemand

[11] Patent Number: 5,333,857

[45] Date of Patent: Aug. 2, 1994

[54] HOCKEY STICK

[75] Inventor: Alain Lallemand, Boecourt, Switzerland

[73] Assignee: Composites-Busch & Cie, Switzerland

[21] Appl. No.: 998,519

[22] Filed: Dec. 30, 1992

[30] Foreign Application Priority Data

Oct. 15, 1992 [CH] Switzerland ..... 3220/92-6

[51] Int. Cl.[5] ..... A63B 59/12

[52] U.S. Cl. ..... 273/67 A; 273/67 R

[58] Field of Search ..... 273/67 A, 72 R, 72 A, 273/80.8, 73 J, 80 R

[56] References Cited

U.S. PATENT DOCUMENTS

| | | | |
|---|---|---|---|
| 3,727,295 | 4/1973 | Gildemeister | 273/72 A |
| 4,013,288 | 3/1977 | Goverde | 273/67 A |
| 4,084,818 | 4/1978 | Goupil | 273/67 A |
| 4,591,155 | 5/1986 | Adachi | 273/67 A |
| 4,793,616 | 12/1988 | Fernandez | 273/169 |
| 5,050,878 | 9/1991 | Deleris | 273/72 R |

FOREIGN PATENT DOCUMENTS

| | | | |
|---|---|---|---|
| 1063747 | 10/1979 | Canada | 273/67 A |
| 2005952 | 12/1971 | Fed. Rep. of Germany | 273/67 A |
| 2638368 | 10/1988 | France | 273/67 A |
| 8900951 | 11/1990 | Netherlands | 273/67 A |

OTHER PUBLICATIONS

"Pill-Buoy" (Advertisement), The Sporting Goods Dealer, May, 1977 p. 144.

*Primary Examiner*—Mark S. Graham

*Attorney, Agent, or Firm*—Woodard, Emhardt, Naughton, Moriarty & McNett

[57] ABSTRACT

The hockey stick comprises a shaft, a blade and a heel forming the connection between the blade and the shaft. It comprises a core having several parts (11, 12, 13), each part being made from synthetic foam having a different density to that of the other parts, based on different materials, in order to adapt the resistance and the characteristics of each part to the particular local stresses of the stick. The core is covered with three layers of woven materials (1, 2, 3).

40 Claims, 3 Drawing Sheets

HOCKEY STICK

FIELD OF THE INVENTION

The present invention relates to a hockey stick, in particular for ice hockey, hockey on earth or grass, roller hockey or skater hockey.

DESCRIPTION OF THE PRIOR ART

Conventional wooden hockey sticks quickly become worn out, in particular in the heel region. In fact, under the effect of the repeated and violent stresses to which the stick is exposed, water or humidity gradually begin to infiltrate the cracks which form in the heel, then the phenomenon quickly spreads until the layers on the stick peel off.

On the other hand, with hockey sticks made on a small scale by craftsmen, the curve of the blade very often varies from one stick and another. These differences are annoying for the player who frequently changes his stick. A good ice hockey player, for example, uses an impressive number of sticks each year, both for training and for competition.

For these reasons, hockey sticks made of composite materials have recently appeared, and the purpose of the methods used in these sticks is to try firstly to prevent the stick becoming rapidly worn and secondly to ensure a better standardisation of a stick of a given type.

Thus, U.S. Pat. No. 4,591,155 describes a hockey stick comprising three layers of strands made from plastic material. The strands of the first layer are wound circumferentially around the core of the stick. The strands of the second layer are disposed in the longitudinal direction of the stick. The strands of the third layer are disposed in various directions and are preferably woven. These strands may be made from carbon fibers or glass fibers or a mixture of both of these. The core of the shaft comes to fit into the core of the blade, made from plastic foam. However, this document does not specify what type of foam to use.

A hockey stick comprising a core made from expanded vinyl chloride foam is described in the French patent published under No. 2,638,368. The core, which has the general profile of the stick, is pressed into a first mesh made from glass fibers or carbon fibers, the entirety being placed and pressed into at least one other mesh made of glass fibers or carbon fibers.

However, sticks made from composite materials which have hitherto been proposed do not enable comfort in play comparable with that with a conventional wooden stick to be achieved. In particular, known sticks made from composite materials produce vibrations in the players' hands and become quickly worn out. Secondly, the foams which have hitherto been proposed to form the core of the stick and in particular the blade produce a hollow effect in the event of a shock caused by hitting the puck, which is prejudicial to good contact with the puck and good control of the puck.

SUMMARY OF THE INVENTION

The object of the present invention is to propose a hockey stick made from composite materials which enables the disadvantages of known sticks made from composite materials to be remedied and which enables in particular the comfort when playing to be at least as good as with a conventional wooden hockey stick.

To this end, the invention relates to a hockey stick, in particular for ice hockey, hockey on earth or on grass, skater hockey or roller hockey, comprising a shaft, a blade and a heel forming the connection between the blade and the shaft, and comprising a core having at least two parts, each part of the core being made from a synthetic foam having a different density to that of the other part or other parts respectively, based on different materials, in order to adapt the resistance and the characteristics of each part to the particular local stresses of the stick, said core being covered with at least three layers of woven materials.

Other important characteristics of the invention are set forth in the claims.

Apart from the advantages which are directly attributed to the fact that the object sought is achieved with the hockey stick in accordance with the invention, the said hockey stick offers an increase in strength when compared with known hockey sticks made from composite materials, which is translated by an increase in the speed of the puck, and also a much greater resistance to wear and tear.

BRIEF DESCRIPTION OF THE DRAWINGS

The following description, given by way of example, refers to the drawings in which.

EMBODIMENTS

Figure 1:
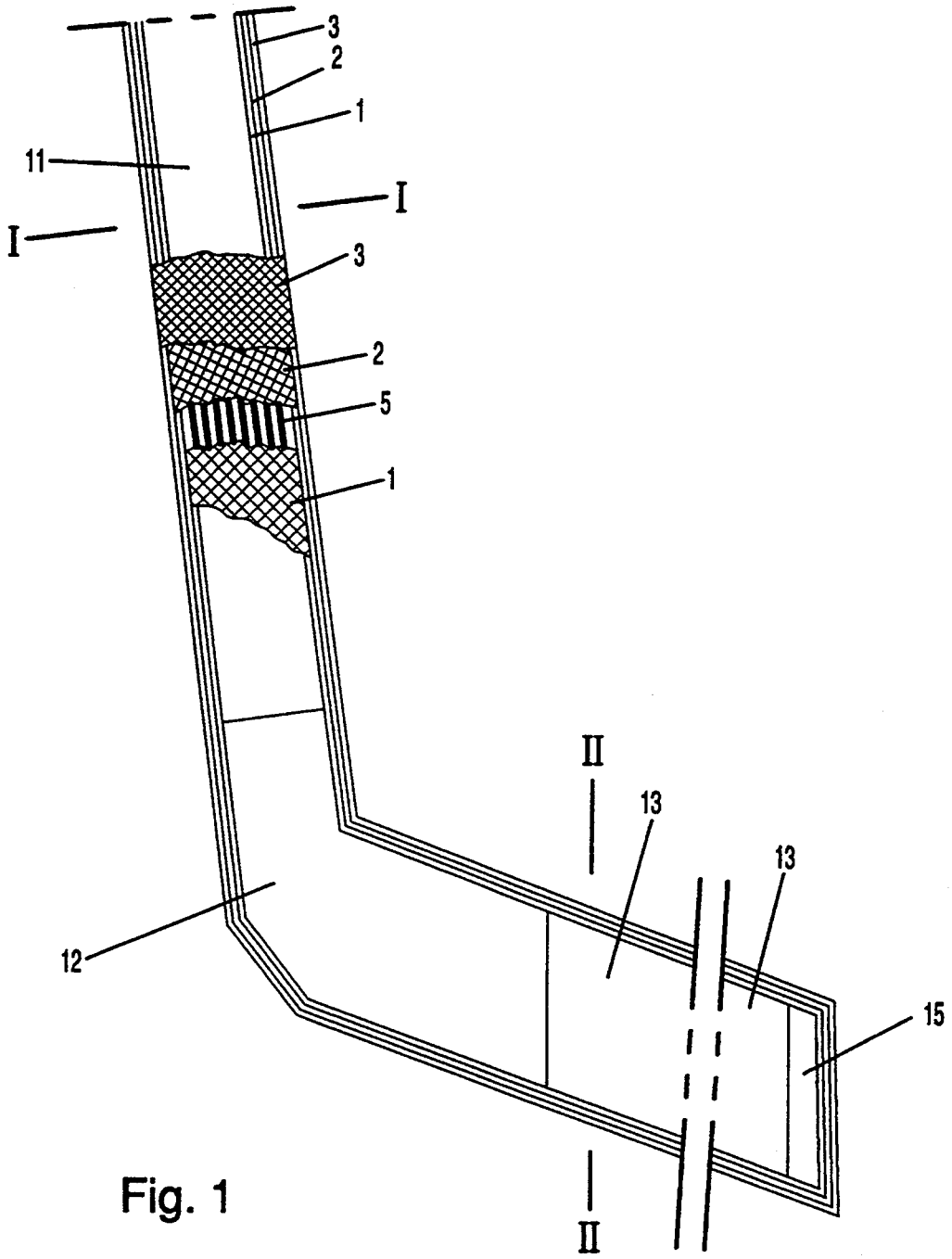
FIG. 1 is a partial diagrammatical longitudinal section of an exemplified embodiment of a stick according to the invention.
Figure 2:
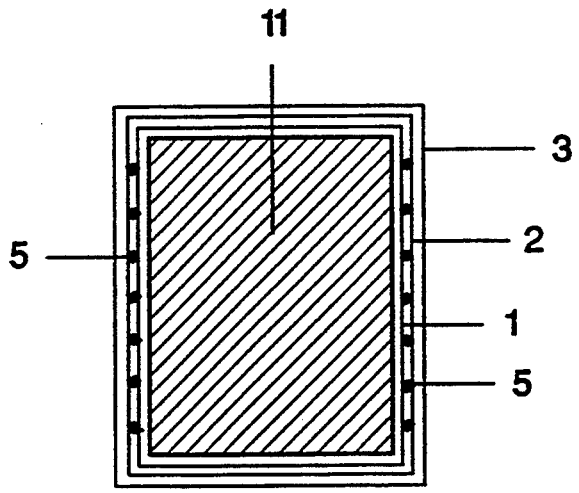
FIG. 2 is a cross section of the shaft along line I—I of the stick in FIG. 1.
Figure 3:
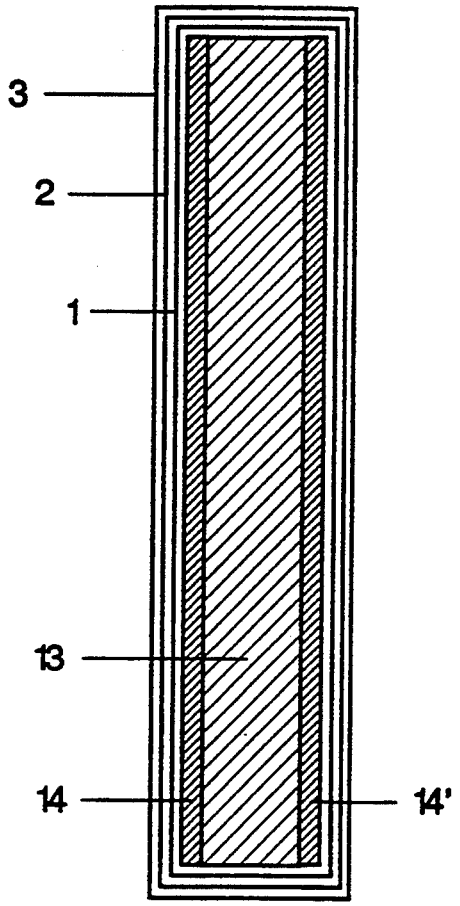
FIG. 3 is a cross section of the blade along line II—II of the stick in FIG. 1.

The stick in FIGS. 1 to 3 comprises a core 11, 12, 13 having the general profile of the stick. This core is covered with three superposed meshes 1, 2 and 3. A sock 4 comprising strands of unidirectional fibers 5 may be sandwiched between the first and second meshes. The core comprises several parts. Each part is made from a foam having a density different to that of the other parts, based on different materials, so as to adapt the resistance and the characteristics of each part to the particular local stresses of the stick.

Figure 4:
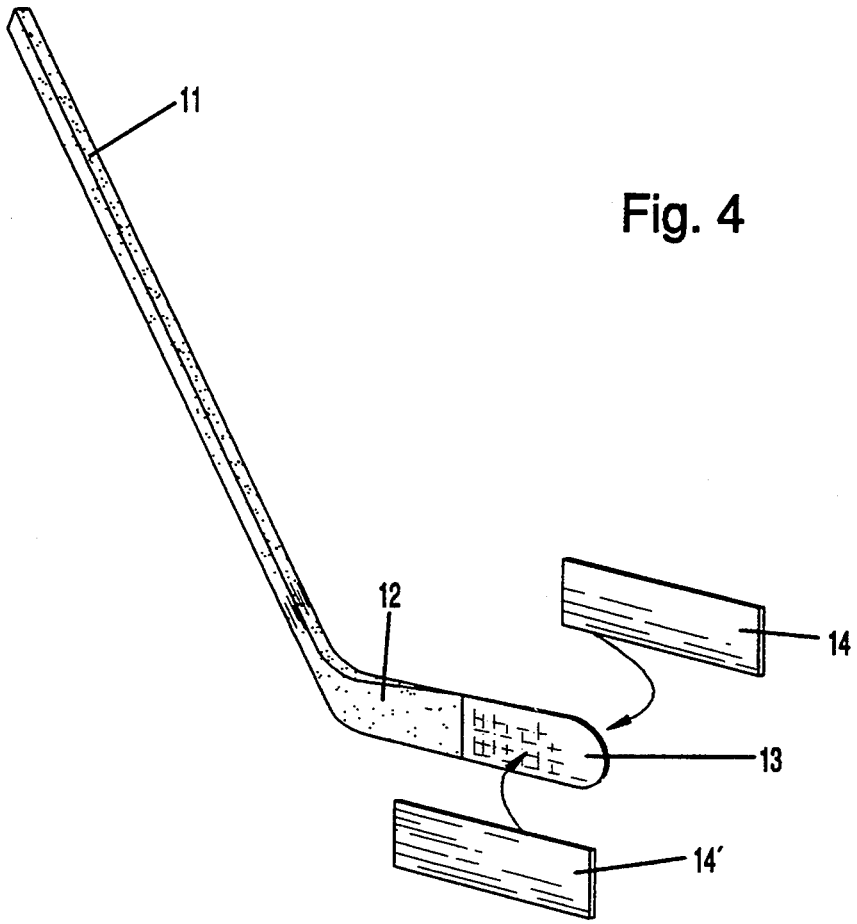
FIG. 4 is a partially exploded overall diagrammatical view of the core of the stick in FIG. 1, before it is covered with the meshes.

Thus, as shown in FIG. 4, the first part 11 of the core, the length of which corresponds roughly to the length of the shaft of the stick, will preferably be made with a light foam, having a density of preferably between 60 and 90 kg/m$^3$, which enables the vibrations to be damped and capable of not becoming deformed during the exothermic treatment of the resin which becomes wrinkled at above 100°. For example, an isotropic foam of the type CK 75 KLEGECELL, which is in use in commerce and has a density of 80 kg/m$^3$, for example, will be used. This type of foam has the advantage of not absorbing the resin, in contrast to PVC foam. The absorption of resin results into an increase in weight, which is why one wishes to avoid its use. Furthermore, the foam which is advocated here does not collapse. The first part 11 of the core may also be cut out of a block of PEI foam (polyester imide).

The second part 12 of the core, which roughly corresponds to the heel of the stick, forming the shaft/blade connection, must be light, have a density of preferably between 60 and 90 kg/m$^3$, and be heat-formable to enable the preforming operation. This part will be cut out, for example by means of a press, in a sheet of reticular foam commercially available under the mark KLEGECELL, of the Ductile Cross Like PVC type, so as to obtain a bent sheet component. This component is then heated, then the profile of the heel is obtained by thermoforming, so that one end of the heel has a rectangular section corresponding to the section of the core of the shaft and so that the other end of said heel has a tapered section corresponding to that of the core of the blade.

The third part 13 of the core, the profile of which is roughly that of a thin plate, must absorb the shocks so as to enable good control of the puck, when receiving and dribbling, for example- For this purpose will be used a high-density, shock-resistant and impact-resistant foam, preferably having a density of between 90 and 160 kg/m$^3$. This part may be cut, for example by means of a press, out of a non-reticular sheet of foam commercially available under the trade mark KLEGECELL CW 80 (green foam), having, for example, a density of 100 kg/m$^3$. According to a variant embodiment, the third part 13 of the core may be cut from a sheet of glass-/epoxy.

The three parts of the core are made integral, so as to facilitate the covering operation, by any adequate means, such as, for example, by stapling, adhesive tape or sticking. Attachment and interlocking members may be provided at the ends of the parts.

Furthermore the core 13 may be partially or entirely lined, on one and/or the other of its face, with a coating 14, 14' of unidirectional carbon or glass, in order to increase the hardness of the blade. The length of this lining depends on the degree of hardness one wishes to achieve. The keeping in place of these pieces of carbon or unidirectional glass coating may also be effected by any adequate means, such as, for example, by stapling, adhesive tape or sticking. Such a coating enables the blade to be made rigid and a better striking accuracy to be obtained. According to a variant embodiment, this coating may be performed not directly on the core, but on one of the meshes 1, 2 and 3.

On the other hand, the core of the blade may be extended at its end with an element 15 made of unidirectional carbon a few centimeters long, it being possible to adjust the dimensions and the shape of this element to the player's convenience, without having a bad affect of the foam core of the stick.

When the different parts of the core have been interlocked as described above, covering by means of the meshes may be performed. The positioning of the meshes is performed by threading them successively on to the free end of the shaft, then by connecting them together to their ends, for example by means of twine or an elastic element.

The meshes may be made from carbon, aramide, glass E, glass R, polyethylene HP (Dyneema), quartz fibers, etc.

According to one embodiment of the stick, the first and the third meshes 1 and 3 are made of carbon fibers, the second mesh 2 being made from a mixture of carbon, quartz and polyethylene fibers (for example fibers of the mark DYNEEMA), for example in a proportion of 50%, 25% and 25%. Each of the meshes may be made of fibers crossing at 45°. However any other mesh of fibers crossing at between 30° and 60° may be allowed, depending on the rigidity one wishes to obtain. The use of polyethylene fibers is advantageous should the stick break, because these particularly strong fibers do not become separated and, for this reason, substantially reduce the risk of injury to the players.

According to a variant embodiment, one of the above meshes may be replaced by a mesh made of glass fibers, of carbon fibers or a mixture thereof, one or more of the glass or carbon fibers being replaced by a thread made of a viscoelastic material of the type of those used in the manufacture of skis or of liquid crystal polymer fibers or again a mixture of the two. A mesh of this type enables a very significant reduction in vibrations.

Figure 5:
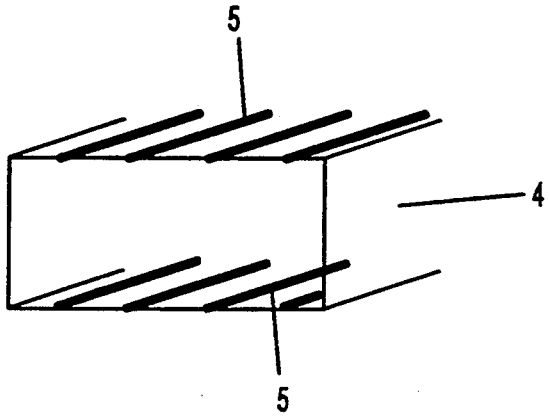
FIG. 5 illustrates an exemplified embodiment of a sock for reinforcing the shaft comprising strands of unidirectional fibers.

A sock 4 comprising strands of unidirectional fibers 5 on two of its faces, as represented in FIG. 5, may be disposed between the first and second mesh, over all or a part of the length of the shaft from the heel, or in a localised manner along the shaft, so that the unidirectional fibers are disposed on the lateral faces of the shaft. This sock forms a reinforcement for the shaft. If necessary, it may be replaced by two strips comprising such strands of unidirectional fibers. The length of this sock or of these strips will be proportional to the rigidity one wishes to give the shaft. The fibers may be glass, carbon or aramid fibers or a mixture thereof.

When the covering operation is complete, the impregnation of the stick is performed by means of a resin, such as pure or modified epoxy resin or a thermoplastic resin, or any other particularly fluid resin, by using the known process for impregnating fibers by low-pressure injection RTM (Resin Transfer Moulding), consisting of moulding by resin transfer. The use of this process enables an industrialisation of the manufacture of sticks, which was impossible with the manual impregnation methods used hitherto. Moreover, this process also enables a better, more uniform and homogenous, distribution of the resin to be achieved than with the manual impregnation methods hitherto used.

Once the impregnation operation is over, the stick may again be dried, if required. Then it may be covered in paint, and the shaft may be covered with a varnish having a rough structure which prevents the stick sliding in the player's hands.

The hockey stick according to the invention offers a resistance to wear which is derived from the material comprising it. However, the new comfort in use and the enhancement of the players' sensation in particular should be stressed. In fact, it is necessary that the stick gives an impression of strength, of pliability and of homogeneity so that the player can express himself fully. The impression of homogeneity, which here is much stronger than in traditional sticks, apparently paradoxically results from the use of different materials for each of the parts of the stick. One might think that by using different materials, a hybrid, mixed result as it were might be achieved. In fact, the absolute opposite is achieved. As the main component of each part is a material which is perfectly adapted to local stresses, the increased impression of homogeneity results from the fact that each part is perfectly adequate for its function. Similarly, the general equilibrium of the stick, each volume of which is in fact laid down, also depends on the nature of the material which principally occupies this volume at each point of the stick. In fact, the stick according to the invention creates a homogeneity of operation, a dynamic homogeneity as opposed to a static homogeneity. To risk a comparison, it is known that a good fishing rod has a stem having a section which decreases progressively from the shaft towards the end. It is easy to imagine the bizarre sensation felt when using a stick having a constant section instead. In fact, the difference in sensation between hockey sticks of the prior art and the hockey stick according to the invention is of the same category as that between the stick of constant section and the true fishing rod; given that this is a simple comparison and nothing else.

Just like other hockey sticks made from composite materials, the hockey stick according to the invention is indifferent to variations in temperature and humidity. Also, when struck, the velocity of the puck, measured with a hockey stick according to the invention, when compared with the velocity of the puck with a similar strike performed with a conventional wooden hockey stick, is greater than roughly 8,3%. The increase in weight when compared with these conventional hockey sticks may be up to 30%. Furthermore, the torsional flexibility of the shaft and of the blade can be modulated by varying the quantity, the nature and the length of the unidirectional fibers forming the lateral reinforcements of the shaft on the one hand and the size of the lateral sheets of unidirectional carbon lining the faces of the blade on the other hand. When compared with known hockey sticks made of composite materials, the hockey sticks according to the invention do not produce any vibrations in the player's hand, and, as has already been mentioned, the hollow effect is absent from hockey sticks according to the invention, thanks to the design of the blade. It will also be noted than the hockey sticks according to the invention have a much greater resistance to wear than previous hockey sticks made from composite materials.

According to a variant embodiment, the hockey stick may be made with a blade having the characteristics described above, this blade being mounted on a shaft made from another material, such as aluminium, for example.

I claim:

1. A hockey stick, in particular for ice hockey, hockey on earth or on grass, skater hockey or roller hockey, comprising a shaft having a core of synthetic foam of a first density; a thin extended blade having a core material of a second density higher than the first density; and a heel forming the connection between the blade and the shaft and having a core of synthetic foam of a third density less than the second density, wherein the first, second and third densities are selected in order to adapt the resistance and the characteristics of the shaft, blade and heel to the particular local stresses of the hockey stick; and at least three layers of woven materials covering the cores of the shaft, blade and heel.

2. A hockey stick according to claim 1, wherein at least one part of the blade has a core of high-density synthetic foam.

3. A hockey stick according to claim 2, wherein at least one part of the core of the heel is made from ductile synthetic foam.

4. A hockey stick according to claim 3, wherein at least one part of at least one face of the blade comprises a reinforcement made from unidirectional carbon fibers or glass fibers.

5. A hockey stick according to claim 4, wherein the core of the shaft is made of low-density synthetic foam.

6. A hockey stick according to claim 5, wherein the core of the shaft is made from PEI foam (polyester imide).

7. A hockey stick according to claim 6, wherein the shaft of the stick comprises at least one reinforcement made from unidirectional fibers disposed along the longitudinal direction of the shaft and sandwiched between first and second layers of woven materials.

8. A hockey stick according to claim 7, wherein said reinforcement comprises strands of unidirectional fibers disposed on lateral faces of the shaft.

9. A hockey stick according to claim 8, wherein a first layer of woven materials is made from carbon fibers or from glass fiber E or R.

10. A hockey stick according to claim 9, wherein a second layer of woven materials is made from a mixture of carbon fibers, of quartz fibers and of polyethylene fibers.

11. A hockey stick according to claim 10, wherein a third layer of woven materials is made from carbon fibers.

12. A hockey stick according to claim 11, wherein one of the layers of woven materials at least is made from glass fibers or carbon fibers mixed with filaments made of visco-elastic material or of liquid crystal polymer fibers.

13. A hockey stick according to claim 12, wherein the blade comprises a component made of unidirectional carbon disposed in the extension of the core of the blade, at its end, so as to enable an adjustment of the length of the blade and of the shape of its end without modifying the core.

14. A hockey stick according to claim 1, wherein at least one part of the core of the heel is made from ductile synthetic foam.

15. A hockey stick according to claim 14, wherein at least one part of at least one of the faces of the blade comprises a reinforcement made from unidirectional carbon fibers or glass fibers.

16. A hockey stick according to claim 1, wherein at least one part of at least one of the faces of the blade comprises a reinforcement made from unidirectional carbon fibers or glass fibers.

17. A hockey stick according to claim 3, wherein the core of the shaft is made of low-density synthetic foam.

18. A hockey stick according to claim 2, wherein at least one part of at least one of the faces of the blade comprises a reinforcement made from unidirectional carbon fibers or glass fibers.

19. A hockey stick according to claim 1, wherein the core of the shaft is made of low-density synthetic foam.

20. A hockey stick according to claim 19, wherein the shaft of the stick comprises at least one reinforcement made from unidirectional fibers disposed along the longitudinal direction of the shaft and sandwiched between first and second layers of woven materials.

21. A hockey stick according to claim 20, wherein said reinforcement comprises strands of unidirectional fibers disposed on lateral faces of the shaft.

22. A hockey stick according to claim 1, wherein the core of the shaft is made from PEI foam (polyester imide).

23. A hockey stick according to claim 1, wherein the shaft of the stick comprises at least one reinforcement made from unidirectional fibers disposed along the longitudinal direction of the shaft and sandwiched between first and second layers of woven materials.

24. A hockey stick according to claim 23, wherein said reinforcement comprises strands of unidirectional fibers disposed on lateral faces of the shaft.

25. A hockey stick according to claim 1, wherein a first layer of woven materials is made from carbon fibers or from glass fiber E or R.

26. A hockey stick according to claim 25, wherein a second layer of woven materials is made from a mixture of carbon fibers, of quartz fibers and of polyethylene fibers.

27. A hockey stick according to claim 26, wherein a third layer of woven materials is made from carbon fibers.

28. A hockey stick according to claim 27, wherein the blade comprises a component made of unidirectional carbon disposed in the extension of the core of the blade, at its end, so as to enable an adjustment of the length of the blade and of the shape of its end without modifying the core.

29. A hockey stick according to claim 1, wherein one of the layers of woven materials at least is made from glass fibers or carbon fibers mixed with filaments made of visco-elastic material or of liquid crystal polymer fibers.

30. A hockey stick according to claim 1, wherein the blade comprises a component made of unidirectional carbon disposed in the extension of the core of the blade, at its end, so as to enable an adjustment of the length of the blade and of the shape of its end without modifying the core.

31. A hockey stick according to claim 2, wherein the core of the shaft is made of low-density synthetic foam.

32. A hockey stick according to claim 1, wherein a first layer of the woven materials is made from aramid fibers.

33. A hockey stick according to claim 32, comprising a reinforcement made from longitudinal unidirectional glass, carbon or aramid fibers on at least one part of at least one face of the blade or of the shaft.

34. A hockey stick according to claim 33, wherein a second layer of woven materials is made of glass fibers.

35. A hockey stick according to claim 34, wherein a third layer of woven materials is made of glass fibers.

36. A hockey stick according to claim 35, wherein an outer layer of the woven materials includes carbon fibers.

37. A hockey stick according to claim 35, wherein an outer layer of the woven materials includes a blend or mixture of at least two different fibers, including glass fibers.

38. A hockey stick according to claim 35, wherein an outer layer of the woven materials includes a blend or mixture of at least two different fibers, including aramid fibers.

39. A hockey stick according to claim 35, wherein an outer layer of the woven materials includes a blend or mixture of at least two different fibers, including visco-elastic fibers.

40. A hockey stick according to claim 35, wherein an outer layer of the woven materials includes a blend or mixture of at least two different fibers, including liquid crystal polymer fibers.

* * * * *